US007926212B2

(12) United States Patent
Fisher

(10) Patent No.: US 7,926,212 B2
(45) Date of Patent: Apr. 19, 2011

(54) SPEED LIMIT INDICIA FOR TRAFFIC SIGNALS

(76) Inventor: Richard Alan Fisher, Huntington Beach, CA (US)

( * ) Notice: Subject to any disclaimer, the term of this patent is extended or adjusted under 35 U.S.C. 154(b) by 971 days.

(21) Appl. No.: 11/416,805

(22) Filed: May 3, 2006

(65) Prior Publication Data

US 2007/0044358 A1 Mar. 1, 2007

Related U.S. Application Data

(63) Continuation-in-part of application No. 10/899,893, filed on Jul. 27, 2004, now abandoned.

(51) Int. Cl.
*G08G 1/095* (2006.01)

(52) U.S. Cl. ..... 40/541; 40/557; 40/612; 340/928

(58) Field of Classification Search ..... 40/541, 40/581; 340/518.4–815.92, 908, 910, 932, 340/936

See application file for complete search history.

(56) References Cited

U.S. PATENT DOCUMENTS

| | | | | | |
|---|---|---|---|---|---|
| 1,917,165 | A | * | 7/1933 | Thompson | 340/928 |
| 1,962,838 | A | * | 6/1934 | Regester | 40/564 |
| 2,417,443 | A | * | 3/1947 | Paul | 362/374 |
| 2,586,039 | A | * | 2/1952 | Heggedal | 40/594 |
| 3,210,728 | A | * | 10/1965 | Davis et. al. | 340/928 |
| 3,401,596 | A | * | 9/1968 | Hirsch | 353/43 |
| 3,740,716 | A | * | 6/1973 | Sproul, Sr. | 340/928 |
| 4,837,569 | A | * | 6/1989 | Sproul, Sr. | 340/907 |
| 4,977,695 | A | * | 12/1990 | Armbruster | 40/541 |

* cited by examiner

*Primary Examiner* — Cassandra Davis
(74) *Attorney, Agent, or Firm* — Roy A. Ekstrand

(57) ABSTRACT

A traffic signal device includes a plurality of illuminatable light assemblies such as red amber and green used to control traffic flow. A transparent element configured to fit upon the outer surface of the lens of a light assembly supports one or more opaque numerals corresponding to vehicle speed limits. The transparent member baring the speed limit numerals is placed upon the outer surface of the traffic signal lens to impose the speed limit numerals upon the light emitted by the light assembly when illuminated.

6 Claims, 4 Drawing Sheets

SPEED LIMIT INDICIA FOR TRAFFIC SIGNALS

CROSS REFERENCE TO RELATED APPLICATION

This application is a continuation-in-part of application Ser. No. 10/899,893 entitled SPEED LIMIT INDICIA FOR TRAFFIC SIGNALS filed Jul. 27, 2004 now abandoned on behalf of Richard Alan Fisher which is hereby incorporated herein by reference.

FIELD OF THE INVENTION

This invention relates generally to traffic control and signal apparatus of the type provided for communicating traffic control and regulatory information to vehicle operators.

BACKGROUND OF THE INVENTION

Within most industrialized nations, substantial effort is expended in regulating and controlling vehicular traffic. One particularly important species of traffic control device is that which is used to control the passage of vehicles through intersecting portions of streets or roads.

In the United States of America for example, the most common traffic control device used at intersections of streets or roads is typically referred to as "traffic light", 'stop light", or "traffic signal". Such devices generally utilize one or more illuminatable signals or lights. Perhaps the most common device provides a red light (indicating an instruction to stop), a green light (indicating an instruction to proceed) and an amber light (indicating a transition from green to red).

A number of devices may be used for the light or signally portion of such control devices, one of the most well known and pervasive light or signal structures is provided by a simple reflector and color light filter or lens assembly having one or more incandescent lamps within the assembly interior. A newly emerging type of light or signal structure utilizes a lens assembly illuminated by a plurality of light emitting diodes to transmit light through the lens. The lens may be tinted to provide signal light color. Alternatively, a plurality of appropriately colored light emitting diodes may be selected to yield the desired light color.

Another important traffic control need arises in the regulation of vehicle speed. To maintain safe vehicle travel over streets, roads and the like, the maximum permissible speed for vehicles is usually posted along the roadside. Generally, a plurality of "speed limit" signs are provided at convenient positions along streets or roads and are positioned to be readily observable from vehicles passing thereby. While this system of posting speed limits along roadsides functions well for the most part, several limitations in its effectiveness arise. For example, growing vegetation such as trees or bushes along the roadside often obscure the visibility of signs from passing vehicles. In addition, substantial intervals exists between speed limit signs on most roads. As a result, vehicle drivers often travel some distance upon a street or road in ignorance of the maximum speed limit thereon.

Despite the best efforts of traffic control practitioners, there arises a continuing and unresolved general need in the art for improvement in the apparatus utilized in communicating traffic control information to vehicle operators. There further arises a particular need in the art for improvements in the apparatus utilized in such communication which supplements and cooperates in conjunction with conventional apparatus of the type presently used to enhance overall safety and control of vehicle operation.

SUMMARY OF THE INVENTION

Accordingly, it is a general object of the present invention to provide an improved apparatus for communication of traffic control information to vehicle operators. It is a more particular object of the present invention to provide an improved supplemental communication apparatus for use in such control. It is a still more particular object of the present invention to provide an improved supplemental apparatus for use in combination with conventional traffic signals for communicating information to vehicle operators.

In accordance with the present invention, there is provided a speed limit indicia for use in combination with a traffic signal having one or more illuminatable signal light; the speed limit indicia comprising: a transparent element having an inner surface, constructed to overlay at least a portion of at least one of the illuminated signal lights, and an outer surface; and speed limit numerals upon the outer surface formed of a substantially contrasting material, the transparent element placed upon the outer surface and the speed limit numerals being visible when the illuminatable signal is illuminated to communicate a speed limit to vehicle operators. In another sense, the present invention provides a speed limit indicia constructed to be placed upon an illuminatable signal light, the speed limit indicia comprising: a thin transparent element constructed to be supported upon the illuminatable signal light; and a plurality of speed limit numerals formed upon the transparent element, the speed limit indicia being placed upon the illuminatable signal light to impose the speed limit numerals upon illumination produced when the illuminatable signal light is illuminated. In a further sense, the present invention provides a method, for improving a traffic signal having at least one illuminatable signal light, comprising the steps of: providing a transparent element constructed to conform generally to the at least one illuminatable signal light; forming substantially opaque speed limit numerals upon the transparent element; and placing the transparent element upon the at least one illuminatable signal light such that the speed limit numerals are visible when the at least one illuminatable signal light is illuminated.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
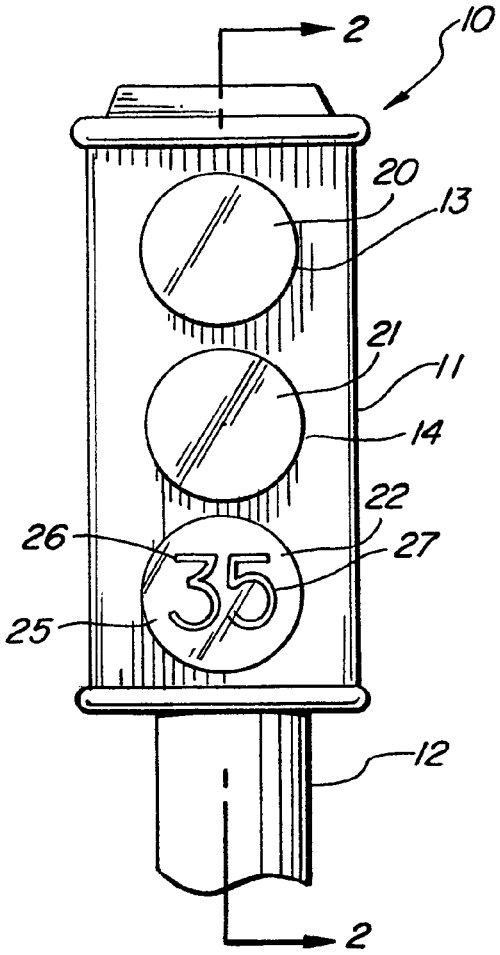
FIG. 1 sets forth a front view of a traffic signal in combination with the present invention speed limit indicia.

FIG. 1 sets forth a front view of a typical traffic signal generally referenced by numeral 10 supporting a speed limit indicia 25 constructed in accordance with the present invention and applied to traffic signal 10 in accordance with the present invention method of improving traffic signals.

More specifically, traffic signal 10 is apart from indicia 25, fabricated in accordance with conventional fabrication techniques and includes a housing 11 which is supported by a vertical post 12. Housing 11 further supports a plurality of illuminatable signal light assemblies 13, 14 and 15 in a standard vertical arrangement. While the utilization of light assemblies 13, 14 and 15 may be varied in accordance with preference, in accordance with the generally standard arrangement utilized within the United States of America, light assembly 13 includes a lens 20 having a red color tint which is operable to emit red light colored illumination when light assembly 13 is illuminated. Similarly, light assembly 14 includes a light transmissive lens 21 tinted to provided to provide an amber colored light when light assembly 14 is illuminated. Finally, light assembly 15 includes a lens 22 having a red tint and operative to emit a red light when light assembly 15 is illuminated.

In accordance with the present invention, a speed limit indicia 25 is supported upon lens 22 and bears a pair of speed limit numerals 26 and 27. While it is recognized that indicia 25 may be equally well positioned upon light assemblies 13 or 14, it has been found preferred to place light indicia 25 upon the green light or 'go" signal provided by light assembly 15. This is preferable due to the likelihood that drivers observing traffic signal 10 at a stop will pay attention to the illumination of green light assembly 15. Further, it is preferably because vehicle drivers approaching an intersection controlled by traffic signal 10 are equally likely to look for and observe the illumination of green light assembly 15 before proceeding through the controlled intersection. Accordingly, with green light assembly 15 illuminated, numeral 26 and 27 which in the example of FIG. 1 provide an indication of a thirty five mile per hour maximum speed limit are very visible to vehicle operators. It will be apparent to those skilled in the art that the virtually automatic attention which vehicle operators give to the controlling traffic signal within. an intersection ensures that the supplemental or reinforcing indication of speed limit applicable to the continuing portion of the street or road leading from the controlled intersection will be clearly and unambiguously observed by vehicle operators. It will be apparent to those skilled in the art that numeral 26 and 27 may be formed of virtually any material or color which provides sufficient contrast with the clear portion of indicia 25 described below and the green light emitted from light assembly 15. However, it has been found preferable to utilize an opaque material preferably a dark color such as black to define numerals 26 and 27.

In accordance with the preferred fabrication of the present invention, indicia 25 is fabricated of a transparent plastic material which readily and easily is applied to and adheres to the outer lens surface of lens 22. The attachment of indicia 25 may, if desired, utilize a temporary adhesive or tape. However, it has been found preferable to utilize material for indicia 25 which readily adheres to the surface of lens 22 without adhesive. Such materials are common and well known in the art and are utilized for example to apply temporary stickers or labels to glass surfaces without adhesive. The avoidance of adhesive renders indicia 25 capable of easy removal and replacement in order to update speed limit numeral data. Also it is recognized that over time indicia 25 may require removal for cleaning and other maintenance and activity.

Figure 2:
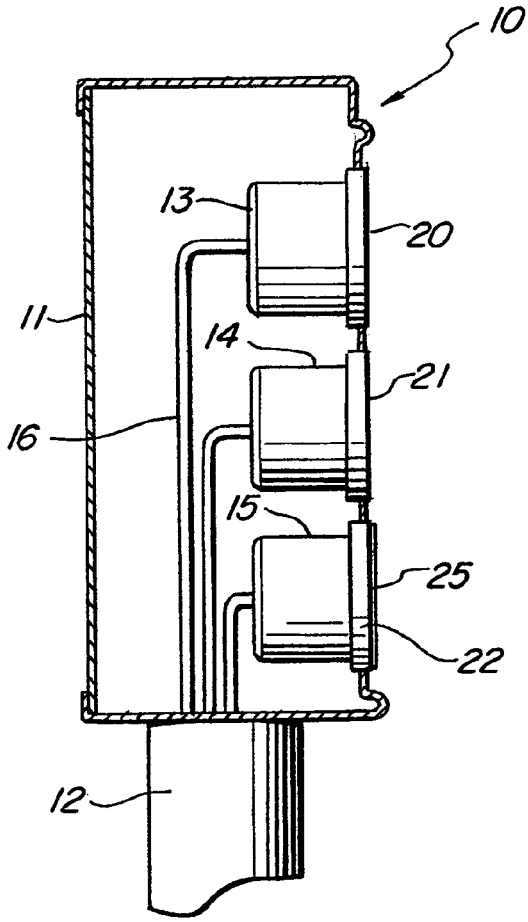
FIG. 2 sets forth a partial section view of the traffic signal of FIG. 1 taken along section lines 2-2 therein.

FIG. 2 sets forth a partial section view of traffic signal 10 taken along section lines 2-2 in FIG. 1. As described above, traffic signal 10 is fabricated in accordance with conventional fabrication techniques but for the installation of indicia 25. Accordingly, traffic signal 10 includes a housing 11 supported by a post 12 and further supporting a red light assembly 13, an amber light assembly 14, and a green light assembly 15. In further accordance with conventional fabrication techniques, a plurality of connecting wires 16 are operative to couple the illumination devices within light assemblies 13, 14 and 15 (seen in FIGS. 4 and 6) to a source of controlling electrical power (not shown). Light assemblies 13, 14 and 15 further support a red light lens 20, an amber light lens 21 and a green light lens 22. In accordance with the present invention, speed limit indicia 25 having speed limit numerals 26 and 27 is supported upon the outer surface of lens 22.

Figure 3:
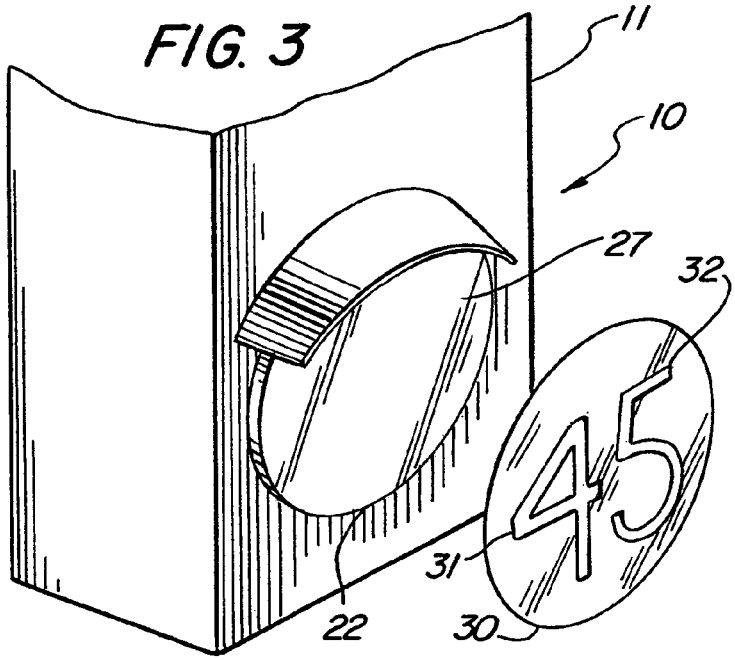
FIG. 3 sets forth a partial perspective assembly view of the present invention speed limit indicia together with a portion of a traffic signal.

FIG. 3 sets forth a partial perspective assembly view of traffic signal 10 having an indicia 30 being assembled thereto.

In accordance with the above-described structure, traffic signal 10 includes a housing 11 which supports a green light lens 22. Lens 22 in the embodiment shown in FIGS. 1, 2 and 3 forms a substantially planar lens having a substantially planar outer surface 27. Accordingly, an indicia 30 fabricated in accordance with the present invention, defines a generally flat shape in correspondence with surface 27. Indicia 30 maybe fabricated utilizing a relatively stiff plastic material preferably transparent or alternatively may be formed of a relatively thin flexible transparent membrane as desired. Indicia 30 is shown supporting speed limit numerals 31 and 32 to indicate a forty five mile per hour speed limit. As described above, the preferred fabrication of the present invention speed limit indicia utilizes a plastic material of the type which readily adheres to another plastic or glass surface without the need for adhesives. Thus, in the assembly shown in FIG. 3, indicia 30 baring numeral 31 and 32 is aligned with surface 27 and pressed against surface 27 to provide adhesion.

Once indicia 30 has been pressed against surface 27 and any air bubbles trapped between indicia 30 and surface 27 have been worked or massaged out, indicia 30 remains against surface 27 of lens 22. Correspondingly, each time lens 22 is illuminated by the green light assembly (assembly 15 seen in FIGS. 1 and 2), the green light shinning outwardly through lens 22 passes through transparent indicia 30 and thereby has the shapes of numerals 31 and 32 imposed on the transmitted light. States simply, once the green light assembly supporting indicia 30 is illuminated, numerals 31 and 32 become clearly visible to those drivers observing the traffic signal.

It is important to note that the preferred use of the present invention speed limit indicia for traffic signals is primarily intended to provide additional or supplemental communication of speed limits for traffic control. Thus, in the most likely utilization of the present invention speed limit indicia, the conventional posted speed limit signs presently used would continue in use. However, it will be apparent that the addition of the present invention speed limit indicia will further enhance the communication of speed limits to vehicle operators due to the inherent likelihood that such operators will observe the traffic light signals while driving. In addition, with the communication of speed limit numerals utilizing the present invention indicia, drivers passing through a controlled intersection will immediately know- the speed limit for the upcoming road portion rather than being ignorant of the speed limit until encountering the next posted speed limit sign.

Figure 4:
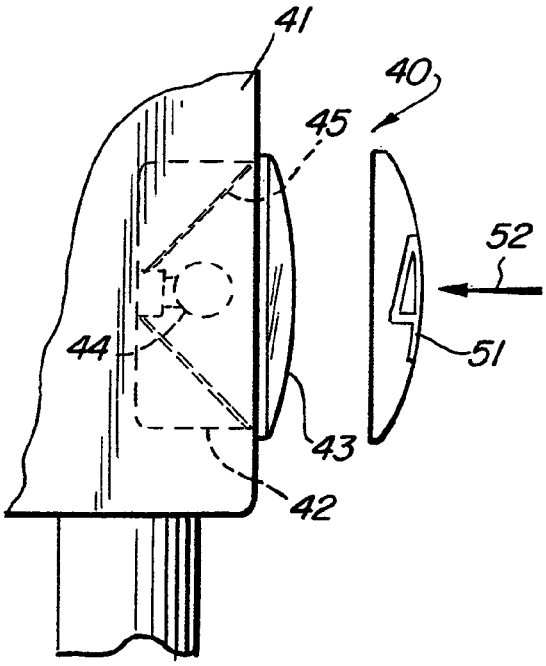
FIG. 4 sets forth a partial side assembly view of the present invention speed limit indicia and a traffic signal.
Figure 5:
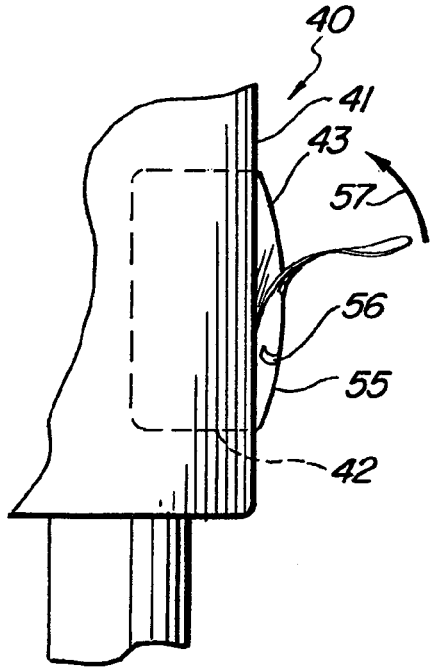
FIG. 5 sets forth a partial assembly view of an alternate embodiment of the present invention speed limit indicia being applied to a traffic signal.
Figure 6:
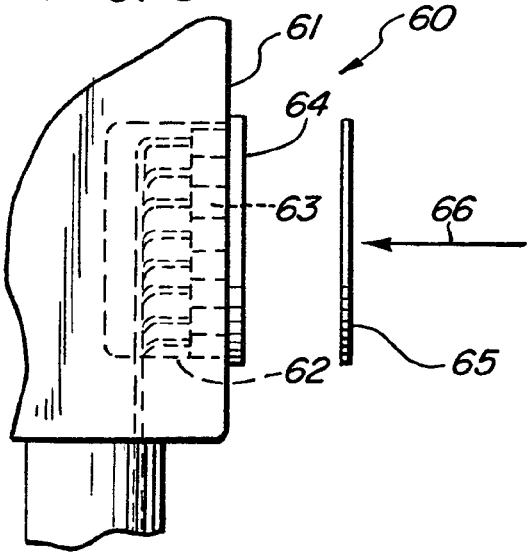
FIG. 6 sets forth a further alternate embodiment of the present invention speed limit indicia being assembled to a traffic signal.
Figure 7:
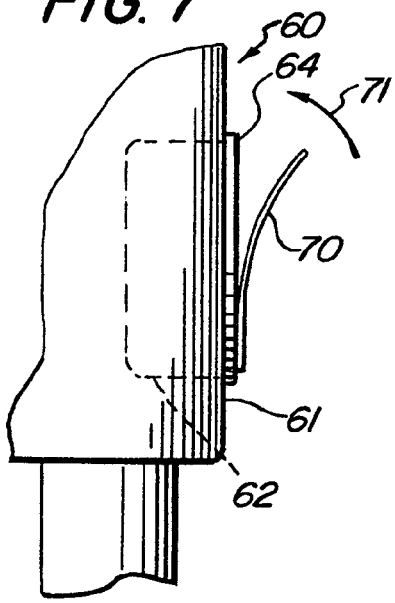
FIG. 7 sets forth a partial assembly view of a still further alternate embodiment of the present invention speed limit indicia and a traffic control signal.

By way of overview, FIGS. 4 through 7 set forth alternate embodiments of the present invention which are directed primarily toward accommodating different shapes of lens for traffic signal light assemblies. Byway of further overview, FIGS. 4 and 6 illustrate the use of relatively stiff transparent elements which are preformed to conform to the outer surface of the host light assembly while FIGS. 5 and 7 illustrate the alternate fabrication of the present invention in which the transparent element of the present speed limit indicia is formed of a relatively thin flexible material.

More specifically, FIG. 4 sets forth a partial side view of a conventional traffic signal 40 having a light assembly 42 supported thereon. Light assembly 42 is fabricated to include a reflector 45 and an incandescent lamp 44. A tinted lens 43 which may for example be colored green is supported on the outer surface of housing 41. In the fabrication utilized in traffic signal 40, the outer surface of lens 43 is generally spherical in shape. Correspondingly, a speed limit indicia 50 fabricated in accordance with the present invention and formed of a generally spherically shaped transparent material such as plastic or the like bares one of more speed limit numerals such as numeral 51.

The assembly of indicia 50 to lens 43 is carried forward by simply forcing indicia 50 against the outer surface of lens 43 in the direction indicated by arrow 52. As mentioned above, an adhesive or tape attachment material may be utilized to secure indicia 50. However, as is also described above, the preferred fabrication of the present invention utilizes the adhesion of the material of indicia 50 to the surface of lens 43 to provide sufficient retention thereof. In this manner, indicia 50 maybe readily removed from lens 43 and replaced or renewed.

FIG. 5 sets forth a partial side view of an alternate embodiment of the present invention indicia generally referenced by numeral 55. As described in FIG. 4, traffic signal 40 includes a housing 41 supporting a light assembly 42 which includes a spherically curved lens 43. In accordance with the alternate embodiment of the present invention, indicia 55 is fabricated of a flexible thin membrane which is readily conformed to the curved surface of lens 43. While the thin flexible material of indicia 55 may be formed in a flat shape and formed upon the surface of lens 43 due to its flexibility, in the preferred fabrication of the present invention, indicia 55 is preformed with a shape generally corresponding to the curved shape of lens 43. In such case, indicia 55 baring speed limit numerals such as numeral 56 is positioned against the outer surface of lens 43 and then formed upon the outer surface of lens 43 as indicated by arrow 57.

FIG. 6 sets forth a side view of a portion of a conventional traffic signal 60 together with a still further alternate embodiment of the present invention speed limit indicia. Traffic signal 60 includes a housing 61 having a light assembly 62 supported therein. Light assembly 62 includes a generally planar lens 64 having a generally flat outer surface. Light assembly 62 further includes a plurality of light emitting diodes 63 supported behind lens 64 in a dense array which provide relatively uniform illumination of lens 64. In accordance with the embodiment of the present invention set forth in FIG. 6, a generally planar speed limit indicia 65 is fabricated of a relatively stiff transparent material such as plastic or the like. Indicia 65 is assembled to lens 64 by pressing it against the outer surface of lens 64 in the direction indicated by arrow 66. Once again, it will be noted that an adhesive or attachment material such as tape or the like may be utilized in securing indicia 65 to the outer surface of lens 64. However, in the preferred fabrication of the present invention, the material of indicia 65 is selected to provide the above mentioned type of adhesion or attachment to lens 64.

FIG. 7 sets forth a partial side view of a traffic signal 60 having a still further alternate embodiment of the present invention speed limit indicia generally referenced by numeral 70 being assembled thereto. As described above, traffic signal 60 is fabricated in accordance with conventional fabrication techniques and includes a light assembly 62 having a generally planar 64. An indicia 70 fabricated in accordance with an alternate embodiment of the present invention is formed of a transparent relatively thin and flexible membrane such as plastic or the like. Indicia 70 which supports one or more speed limit numerals in the manner indicated for example in FIG. 3 is assembled to lens 64 by simply pressing indicia 70 in a manner indicated by arrow 71 to secure indicia 70. Indicia 70 is easily removed from lens 64 in a reverse operation by simply grasping any edge portion of indicia 70 and withdrawing it away from lens 64.

Figure 8:
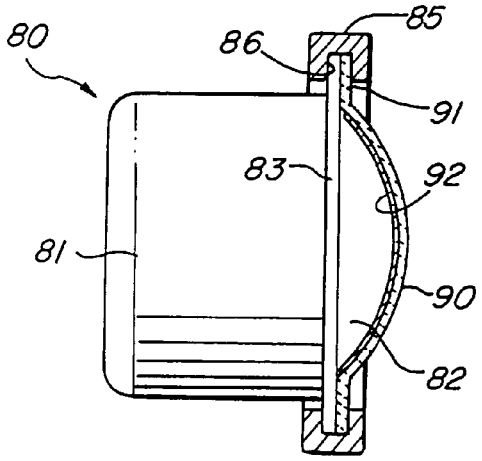
FIG. 8 sets forth a partial section side view of a still further alternate embodiment of the present invention speed limit indicia and traffic control signal.

FIG. 8 sets forth a partial sectioned side view of a speed limit indicia and light assembly constructed in accordance with the present invention and generally referenced by numeral 80. Light assembly 80 is constructed in the manner described above and includes a supporting housing 81 within which a lens 82 having a flange 83 is supported. A circular gasket 85 formed of a resilient material such as rubber or plastic defines an interior channel 26 and is received upon flange 83 of lens 82. In accordance with the present invention, a speed limit indicia 90 formed of a transparent material such as glass or plastic defines an outer flange 91 which is also received within channel 86. Indicia 90 is generally formed to conform to the outer surface of lens 82. Thus, gasket 85 cooperates to secure indicia 90 upon lens 82 of light assembly 80. In further accordance with the present invention, a pair of opaque speed limit numerals 92 and 93 (numeral 93 seen in FIG. 9) are supported upon the interior surface of indicia 90. With temporary reference to FIG. 11, it will be noted that numerals 82 and 83 may alternatively be placed upon the outer surface of indicia 90 in certain applications as preferred.

Figure 9:
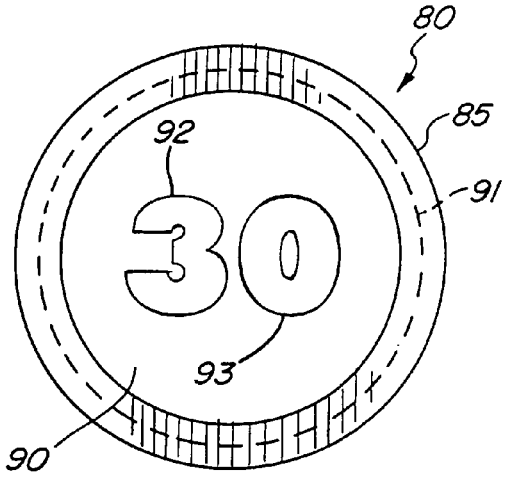
FIG. 9 sets forth a front view of the embodiment of FIG. 8.

FIG. 9 sets forth a front view of light assembly 80 showing speed limit indicia 90 supported upon light assembly 80 and secured by outer gasket 85. As mentioned above, indicia 90 defines a outer flange 91 which is received within interior channel 86 of gasket 85 of the manner shown in FIG. 8. As is also described above, speed limit numerals 92 and 93 are formed of a opaque material upon the interior surface of indicia 90. The clear or transparent material of indicia 90 insures that opaque numerals 92 and 93 together with the light created within light assembly 80 are visible from the frontal region of light assembly 80.

Figure 10:
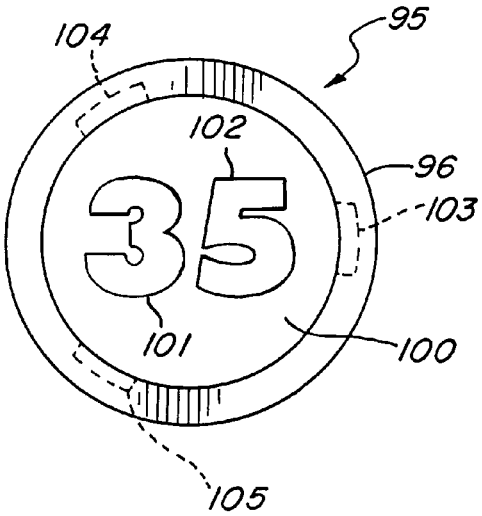
FIG. 10 sets forth a front view of a still further alternate embodiment of the present invention speed limit indicia and traffic control signal.

FIG. 10 sets forth a front view of a still further alternate embodiment of the present invention. A light assembly 95 fabricated in the manner described above includes a surrounding gasket 96. In accordance of the embodiment of FIG. 10, a speed limit indicia 100 supports a pair of opaque numerals 101 and 102. Indicia 100 further includes a pair of outwardly extending flange segments 103, 104 and 105. With temporary return to FIG. 8, it will be understood that flange segments 103, 104 and 105 are received within the interior channel of gasket 96 in the same manner of flange 91 of indicia 90 is received within channel 86 of gasket 85. The advantage of flange segments such as segments 103, 104 and 105 rather than a continuous flange as set forth above as flange 91 in FIG. 8 is found primarily in the ease of installation. It has been found somewhat easier to install and remove indicia 100 with its flange segments to and from gasket 96.

Figure 11:
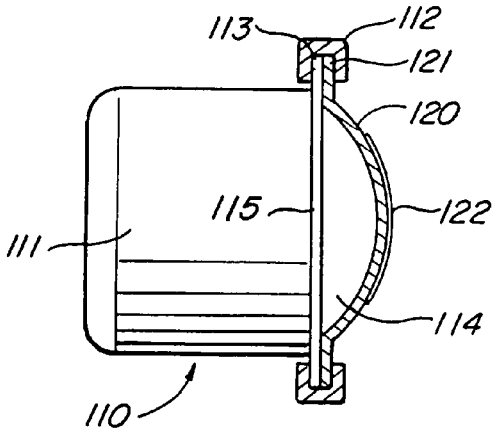
FIG. 11 sets forth a partial section side view of a still further alternate embodiment of the present invention speed limit indicia and traffic control signal.

FIG. 11 sets forth a partial section side view of a still further alternate embodiment of present invention. A light assembly 110 fabricated in the manner described above includes a housing 111 which receives and supports a lens 114 having an outer flange 115. A surrounding gasket 112 formed of a resilient material such as plastic or rubber encircles flange 115 receiving flange 115 within interior channel 113 formed within gasket 112. In similarity to the above described embodiment shown in FIGS. 8 and 9, an indicia 120 is shaped to conform generally to and overlie lens 114. Indicia 120 includes an extending flange 121 which is also received within channel 113 of gasket 112. Indicia 120 differs from indicia 90 shown in FIGS. 8 and 9 in that a speed limit numeral 122 is formed on the outer surface of indicia 120. It has been found that in certain applications, this outer numeral embodiment has advantages of ease of installation and change.

Figure 12:
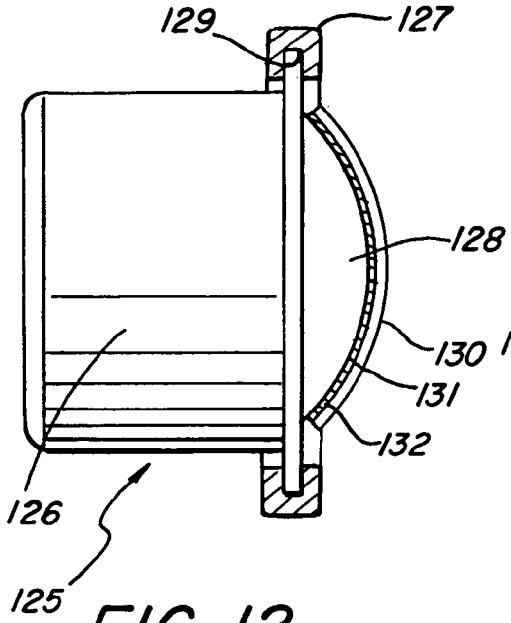
FIG. 12 sets forth a partial section side view of a still further alternate embodiment of the present invention speed limit indicia and traffic control signals.

FIG. 12 sets forth a partially sectioned side elevation view of a still further alternate embodiment of the present invention speed limit indicia. A light assembly 125 is fabricated in the manner described above and includes a housing 126 together with a lens 128 having an outer flange 129. Flange 129 is received within the interior channel of surrounding gasket 127 in accordance with the above described fabrication of conventional light assemblies. In accordance with the alternate embodiment of the present invention shown in FIG. 12, a speed limit indicia 130 is configured to conform generally to the outer surface of lens 128. Indicia 130 supports one or more speed limit numerals 131 on the interior surface of indicia 130. A adhesive attachment 132 is also supported upon the interior surface of indicia 130. Adhesive attachment 132 provides the primary attachment between indicia 130 and lens 128. The advantage found in utilizing adhesive 132 is found primarily in the ease of attachment and removal of indicia 130 without disturbing gasket 127.

Figure 13:
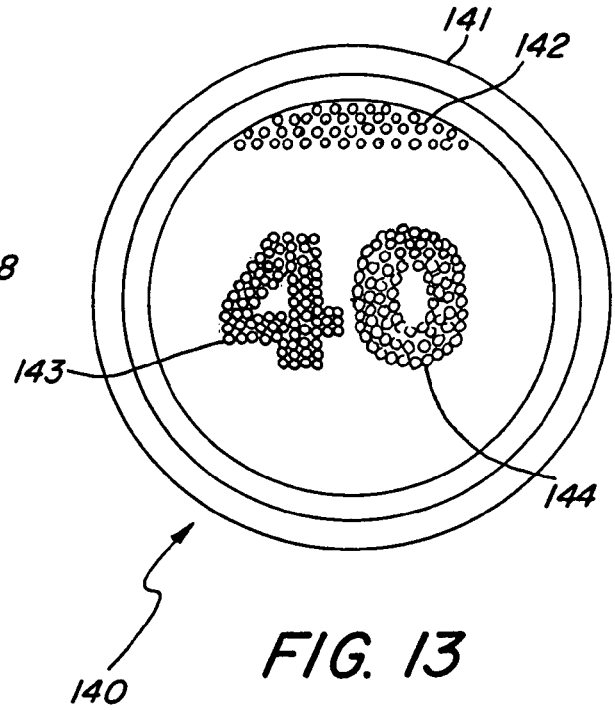
FIG. 13 sets forth a front view of a still further alternate embodiment of the present invention speed limit indicia and traffic control signal.

FIG. 13 sets forth a front view of a still further alternate embodiment of the present invention in which a plurality of light emitting diodes 142 are arranged in a tightly spaced planar arrangement to provide the light source for light assembly 140. A surrounding gasket 141 provides a weather seal for light assembly 140. In accordance with the embodiment of the present invention shown in FIG. 13, a pair of numerals 143 and 144 are formed and made visible by selectively energizing light emitting diode in a pattern in which numerals 143 and 144 are formed by light emitting diodes which remain unlighted or non-energized while the remaining light emitting diodes within light emitting diodes 142 are energized providing light. The darkened numerals provided by the selective non-illumination of light emitting diodes which form numerals 143 and 144 provide the appearance of opaque or darkened numerals within the field of lighted light emitting diodes on the remainder of light assembly 140. It will be apparent to those skilled in the art that the use of selective illumination and non-illumination of certain groups of light emitting diodes within a light assembly such as light assembly 140 provides substantial flexibility and ease of change for the operator. In essence, the operator simply utilizes the light emitting diode apparatus shown in FIG. 6 and described above and interrupts the power applied to the selected non-illuminated or non-activated light emitting diodes forming numerals 143 and 144.

Figure 14:
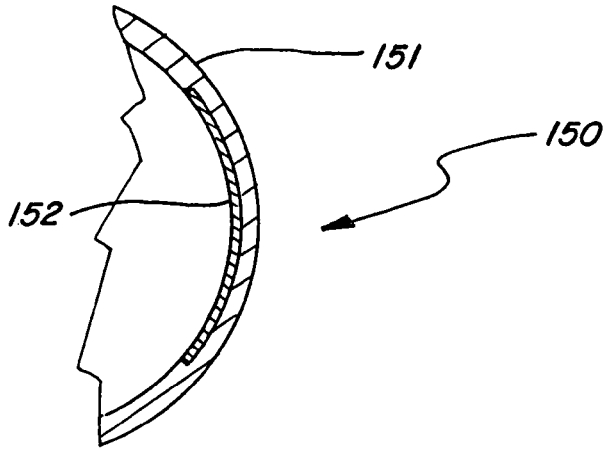
FIG. 14 sets forth a partial section view of a still further embodiment of the present invention speed limit indicia having speed limit numerals molded into the indicia.

FIG. 14 sets forth a partial section view of a speed limit indicia constructed in accordance with the present invention which is generally referenced by numeral 150. Indicia 150 is fabricated in accordance with any of the above-described indicia structures. Also, indicia 150 may be secured to the lens of a traffic signal in any of the above-described manners. The importance of indicia 150 is found in the use of molded-in speed limit numerals as illustrated by molded-in numeral 152 which is generally opaque. The remainder of indicia 150 (referenced by numeral 151) is preferably formed of a clear or transparent color-tinted material such as clear plastic or the like. Molding numerals into indicia 150 provides a more durable and permanent device.

What has been shown is a speed limit indicia for traffic signals which is easy to manufacture and low in cost while providing effective communication of import speed information to vehicle operators. The speed limit indicia provided by the present invention is usable in virtually any type of traffic signal device and is particularly adaptable to the conventional traffic lights utilized within the United States of America. Embodiments are shown which accommodate both curved lens light assemblies as well as generally flat light assemblies.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A speed limit indicia for use in combination with a traffic signal having at least one illuminatable signal light which includes a lens and flange secured by a surrounding gasket; said speed limit indicia comprising:

a transparent element having an inner surface, constructed to overlay at least a portion of at least one of said at least one illuminated signal light, an outer flange and an outer surface; and speed limit numerals upon said transparent element surface formed of a substantially contrasting material, said transparent element placed upon said outer surface and secure to said lens by insertion of said flange within said gasket such that said speed limit numerals are visible when said at least one illuminatable signal is illuminated to communicate a speed limit to vehicle operators.

2. The speed limit indicia set forth in claim 1 wherein said transparent element is formed of a transparent plastic material.

3. The speed limit indicia set forth in claim 2 wherein said speed limit numerals are formed of a substantially opaque material.

4. The speed limit indicia set forth in claim 3 wherein said speed limit numerals are substantially black.

5. The speed limit indicia set forth in claim 1 wherein said speed limit numerals are supported upon said inner surface.

6. The speed limit indicia set forth in claim 1 wherein said speed limit numerals are supported upon said outer surface.

* * * * *